US007416268B2

(12) United States Patent
Oku

(10) Patent No.: US 7,416,268 B2
(45) Date of Patent: Aug. 26, 2008

(54) DRIVE CIRCUIT OF PIEZOELECTRIC ELEMENT, DRIVING METHOD THEREOF, LIQUID EJECTION APPARATUS AND IMAGE FORMING APPARATUS

(75) Inventor: Seiichiro Oku, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 339 days.

(21) Appl. No.: 11/188,655

(22) Filed: Jul. 26, 2005

(65) Prior Publication Data

US 2006/0023013 A1 Feb. 2, 2006

(30) Foreign Application Priority Data

Jul. 27, 2004 (JP) ..... 2004-218478

(51) Int. Cl.
*B41J 29/38* (2006.01)

(52) U.S. Cl. ..... 347/11; 347/12

(58) Field of Classification Search ..... 347/10–12, 347/71

See application file for complete search history.

(56) References Cited

U.S. PATENT DOCUMENTS

| | | | |
|---|---|---|---|
| 4,510,509 | A | 4/1985 | Horike et al. |
| 5,923,344 | A | 7/1999 | Norum et al. |
| 6,042,210 | A | 3/2000 | Suematsu et al. |
| 6,154,230 | A | 11/2000 | Holstun et al. |
| 6,193,347 | B1 | 2/2001 | Askeland et al. |
| 6,259,463 | B1 | 7/2001 | Askeland et al. |
| 6,367,903 | B1 | 4/2002 | Gast et al. |
| 2003/0231230 | A1 * | 12/2003 | Shimamoto et al. ..... 347/68 |

FOREIGN PATENT DOCUMENTS

| | | | |
|---|---|---|---|
| JP | 55-95191 | A | 7/1980 |
| JP | 58-153661 | A | 9/1983 |
| JP | 58-153662 | A | 9/1983 |
| JP | 4-341849 | A | 11/1992 |
| JP | 9-109390 | A | 4/1997 |
| JP | 10-34911 | A | 2/1998 |
| JP | 11-208000 | A | 8/1999 |
| JP | 2003-320670 | A | 11/2003 |

* cited by examiner

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

The drive circuit drives a plurality of piezoelectric elements connected in a matrix connection, each of the piezoelectric elements having a first electrode and a second electrode, and the drive circuit comprises: a drive signal generating device which generates a drive signal with voltage of a single polarity to be applied to the piezoelectric elements; a drive controlling device which controls a timing for applying the drive signal to each of the piezoelectric elements; and a plurality of switching devices which apply the drive signal to the piezoelectric elements according to control of the drive controlling device, a number of the plurality of switching devices being smaller than a number of the plurality of piezoelectric elements, wherein the drive controlling device sequentially applies the drive signal with voltage of the single polarity to the first electrode and the second electrode in succession.

20 Claims, 13 Drawing Sheets

DRIVE CIRCUIT OF PIEZOELECTRIC ELEMENT, DRIVING METHOD THEREOF, LIQUID EJECTION APPARATUS AND IMAGE FORMING APPARATUS

BACKGROUND OF THE INVENTION

1. Field of the Invention

The present invention relates to a drive circuit of piezoelectric elements, a driving method thereof, a liquid ejection apparatus and an image forming apparatus, more particularly to a drive technology of a piezoelectric element which is a pressurizing device for an ejection head, the technology being used in an inkjet recording apparatus and the like.

2. Description of the Related Art

As an example of the image forming apparatus, there is known an inkjet recording apparatus which has an inkjet head (ejection head) having disposed multiple nozzles (ejection elements) therein, and forms an image on a medium (ejection receiving medium) by causing the nozzles to eject ink while relatively moving the inkjet head and the medium.

There are various ink ejection methods in an inkjet head of the inkjet recording apparatus. For example, there is known a piezoelectric method where a diaphragm constituting a part of a pressure chamber is deformed by deformation of a piezoelectric element to change the capacity of the pressure chamber, followed by introduction of ink from an ink supply path into the pressure chamber when the capacity of the pressure chamber is increased, and then the ink inside the pressure chamber is ejected as droplets from the nozzle when the capacity of the pressure chamber is reduced. Also there is known a thermal inkjet method where ink in an ink chamber (pressure chamber) is heated to generate bubbles, and then the ink is ejected with the inflation energy occurring when the bubbles grow.

A pressurizing device, such as a piezoelectric element or a heater, which pressurizes ink ejected from the nozzle is driven by means of a switching element such as a transistor. The switching element is turned on or off using a drive signal corresponding to the image data, in response to which the electric power is supplied to the pressurizing device, whereby ejection energy provided to the ink from the pressurizing device is generated. When the ejection energy acts on the ink inside the pressure chamber, the ink is ejected from the nozzle.

However, in an inkjet head such as a full line type inkjet head having multiple nozzles, the number of the switching elements, along with which the number of signal lines that transmit drive signals to the switching elements increases. Such increase of the switching elements and the signal lines contributes to expansion of the head, and has an impact on the increase in electric power consumption and the cost. Therefore, in the inkjet having multiple nozzles, various measures are exercised in order to reduce the switching elements and signal lines.

As an example of reduction of wiring, there are proposed a method for driving grouped nozzle by means of a common signal line for each group, and a method for sharing a signal line by means of a signal line configured in a form of matrix.

Japanese Patent Application Publication No. 11-208000 discloses a printing method, which includes supplying ink from an ink reservoir through an ink channel that connects the ink reservoir with ink ejection chambers formed on a first surface of a substrate. The ink channel is connected at a first end to the ink reservoir and at a second end to a separate inlet passage for refilling each of the ink ejection chambers with ink. A group of the ink ejection chambers in adjacent relationship forms one of a plurality of primitives on the first surface of the substrate in which only a maximum of one of the ink ejection chambers is energized at a time. An ejection element within one of the ink ejection chambers is energized to cause the plurality of ink drops to be ejected onto a media surface at a single pixel location in a single pass of the substrate over the media surface. The plurality of ink drops are maintained as substantially separate drops until the plurality of ink drops merge upon impact with the media. Thereby, the inkjet hardcopy apparatus achieves photographic image quality.

Japanese Patent Application Publication No. 2003-320670 discloses an inkjet recording apparatus, in which a drive circuit of heater elements is constituted by a switching element which drives each of the heater elements, a level shifter which drives the switching element, an AND gate matrix circuit having an AND gate laid over a segment line as the print data and a common line which selectively scans, a segment circuit which load the print data for each print with the number of segment lines, and a common circuit which generates selective scan signals for the number of divisions obtained by dividing the total number of nozzles by the number of segment lines. The drive circuit of heater elements is a drive circuit which has a matrix configuration of the segment line and the common line and is driven in a time-shared fashion, wherein logical multiplications of the segment line and common line are generated in the AND gate, and a calculation result thus obtained is constituted so as to be converted to an application signal and driven in a matrix fashion, whereby it is possible to realize a compact inkjet recording apparatus which has high quality of drive and in which a large number of nozzles and the drive circuit can be integrally created in a long substrate.

Japanese Patent Application Publication Nos. 58-153661 and 58-153662 disclose an inkjet recording apparatus, which comprises a plurality of nozzles that are arranged in x direction and y direction, a first electrode provided on an inner wall of each nozzle or in the vicinity of each nozzle, a second electrode provided at the back of the first electrode or around each nozzle on an ink droplet chamber side on a nozzle substrate face, and a third electrode provided on a recording paper side. The inkjet recording apparatus is constituted so as to apply a pulsing voltage corresponding to image information to the first electrode, apply a pulsing voltage, which has characteristics opposite of those of the pulsing voltage applied to the first electrode, to the printing column of the second electrode, apply none or a pulsing voltage, which has the same polarity as the pulsing voltage applied to the first electrode, to a non-printed column, and apply a certain voltage, which has a reverse polarity from that of the pulsing voltage applied to the first electrode, to the third electrode, so as to stably perform the ink ejection.

Japanese Patent Application Publication No. 4-341849 discloses an inkjet print head, which is provided with a plurality of electrodes on the surface and the back face of a piezoelectric substrate, has disposed therein a nozzle plate provided with nozzles so as to correspond to the region where the surface electrode and the back face electrode intersect, and comprises ink which is held in a gap between the piezoelectric substrate and the nozzle plate, and a drive device which selectively applies a voltage to between the electrodes, the voltage changing in a cycle equal to resonance frequency of the piezoelectric substrate. Each of the electrodes is constituted so as to share a plurality of crossing regions, and makes the ink into the form of a mist by the resonance of the piezoelectric substrate to obtain a gray-scale image.

However, in the method for printing described in Japanese Patent Application Publication No. 11-208000, and the inkjet recording apparatus described in Japanese Patent Application Publication No. 2003-320670, driving elements (transistors, combinations of transistors and AND circuits, or the like), the number of which is equal to the number of pressurizing elements such as ink ejection elements or heater elements, are required, thus it is difficult to minimize the head or drive circuit.

Moreover, in the inkjet recording apparatus described in Japanese Patent Application Publication Nos. 58-153661 and 58-153662, and in the inkjet print head described in Japanese Patent Application Publication No. 4-341849, if lines are connected simply in the form of matrix, a voltage is applied to all of the rows and columns. Further, driving elements are operated using a plurality of signals having different polarities, and power supply units having different polarity and a polarity reversal circuit are required, thus it is difficult to minimize the drive circuit. In addition, the maximum difference in potential between the positive and negative voltages with different polarities has to be less than a withstanding voltage (Vp) of the piezoelectric elements. On the other hand, by applying a deviation voltage from an offset voltage, similar control is possible with the single polarity power supply; however, it is necessary to add the offset voltage and the deformation voltage to the element, whereby a voltage of the piezoelectric voltage that can be used for deformation with respect to the allowable voltage becomes small.

SUMMARY OF THE INVENTION

The present invention has been contrived in view of such circumstances, and the object thereof is to provide a drive circuit of piezoelectric elements, driving method thereof, liquid ejection apparatus and image forming apparatus, in which in a head having multiple nozzles, the number of driving elements that drive pressurizing devices of nozzles, and the number of signal lines that transmit signals are reduced to realize miniaturization and simplification of the drive circuit.

In order to attain the aforementioned object, the present invention is directed to a drive circuit which drives a plurality of piezoelectric elements connected in a matrix connection, each of the piezoelectric elements having a first electrode and a second electrode, the drive circuit comprising: a drive signal generating device which generates a drive signal with voltage of a single polarity to be applied to the piezoelectric elements; a drive controlling device which controls a timing for applying the drive signal to each of the piezoelectric elements; and a plurality of switching devices which apply the drive signal to the piezoelectric elements according to control of the drive controlling device, a number of the plurality of switching devices being smaller than a number of the plurality of piezoelectric elements, wherein the drive controlling device sequentially applies the drive signal with voltage of the single polarity to the first electrode and the second electrode in succession.

Specifically, the drive signal having the same polarity is applied to the first electrode and the second electrode, thus power supply devices with different polarities do not have to be provided separately, and also since the number of switching devices is smaller than the number of the piezoelectric elements, the drive circuit can be simplified.

The piezoelectric element includes ceramic piezoelectric materials such as lead zirconate titanate (Pb (Zr, Ti)$O_3$) called PZT and barium titanate ($BaTiO_3$), or fluorinated resin piezoelectric materials such as polyvinylidene fluoride called PVDF.

The switching device may have semiconductor elements such as a bipolar transistor and a field-effect transistor (FET).

In a mode where the drive signal is sequentially applied in succession, it is possible that the drive signal is applied to the first electrode, and then applied to the second electrode after a predetermined range of time interval elapses. However, it is more preferable that this predetermined range of time interval be zero.

Preferably, in the matrix connection the first electrodes are connected in one of a row direction and a column direction, and the second electrodes are connected in another of the row direction and the column direction.

"Matrix connection" includes a mode where the common signal lines are used to connect the piezoelectric elements in the rows and columns, where the drive signal that is transmitted by the common signal lines is applied at a desired timing to the piezoelectric elements that are selected by the selecting device.

Preferably, the second electrode is set to a reference potential at least in a period in which the drive signal is applied to the first electrode; and the first electrode is set to the reference potential at least in a period in which the drive signal is applied to the second electrode.

"Reference potential" mentioned here may be a ground potential or earth potential (0V), or the voltage that is offset from 0V.

Preferably, a time interval between the drive signal applied to the first electrode and the drive signal applied to the second electrode is not longer than a half of a cycle of the drive signal.

Further, the time interval between the time of application of the drive signal to the first electrode and the time of application of the drive signal to the second electrode is preferably zero.

In order to attain the aforementioned object, the present invention is also directed to a driving method of driving a plurality of piezoelectric elements connected in a matrix connection, each of the piezoelectric elements having a first electrode and a second electrode, the method comprising the steps of: generating a drive signal with voltage of a single polarity to be applied to the piezoelectric elements; controlling a timing for applying the drive signal to each of the piezoelectric elements; and applying the drive signal with voltage of the single polarity to the first electrode and the second electrode in succession according to control of the drive controlling device with a plurality of switching devices, a number of the plurality of switching devices being smaller than a number of the plurality of piezoelectric elements.

In order to attain the aforementioned object, the present invention is also directed to a liquid ejection apparatus, comprising: an ejection head which includes: a plurality of ejection apertures through which liquid is ejected; a plurality of pressure chambers which store the liquid to be ejected through the ejection apertures; a plurality of supply ports through which the liquid is supplied to the pressure chambers; and a plurality of piezoelectric elements which apply pressure to the liquid in the pressure chambers to eject the liquid through the ejection apertures, the piezoelectric elements being connected in a matrix connection, each of the piezoelectric elements having a first electrode and a second electrode; a drive signal generating device which generates a drive signal with voltage of a single polarity to be applied to the piezoelectric elements; a drive controlling device which controls a timing for applying the drive signal to each of the piezoelectric elements; and a plurality of switching devices which apply the drive signal to the piezoelectric elements according to control of the drive controlling device, a number of the plurality of switching devices being smaller than a number of the plurality of piezoelectric elements, wherein the drive controlling device sequentially applies the drive signal with voltage of the single polarity to the first electrode and the second electrode in succession.

Specifically, for the piezoelectric elements, deformation amounts thereof can be obtained by adding a deformation amount corresponding to the maximum voltage of the drive signal applied to the first electrode, to a deformation amount corresponding to the maximum voltage of the drive signal applied to the second electrode. Therefore, the deformation amounts of the piezoelectric elements can be increased when the maximum voltages of the drive signal are the same, in comparison to the case when the piezoelectric elements are driven using the drive signals where the polarities are switched. Furthermore, the maximum voltages of the drive signal can be reduced when the deformation amounts of the piezoelectric elements are made equal to each other.

As a configuration example of the ejection head, a full line type head with columns of nozzles having disposed therein a plurality of nozzles for ink ejection across the full width of an ejection receiving medium.

In this case, a mode may be adopted in which a plurality of relatively short ejection head blocks having nozzle rows that do not reach a length corresponding to the full width of the ejection receiving medium are combined and joined together, thereby forming nozzle rows of a length that correspond to the full width of the ejection receiving medium.

A full line type head is usually disposed in a direction perpendicular to the relative feed direction (relative conveyance direction) of the ejection receiving medium, but modes may also be adopted in which the inkjet head is disposed following an oblique direction that forms a prescribed angle with respect to the direction perpendicular to the relative conveyance direction.

"Ejection head" includes the one called "inkjet head" or "print head" used in an image forming apparatus such as an inkjet recording apparatus.

Preferably, each of the piezoelectric elements has a structure in which a piezoelectric body layer is interposed between the first electrode and the second electrode.

Specifically, the piezoelectric element, which has the structure where the piezoelectric body layer is interposed between the first electrode and second electrode, is operated in opposite directions when applying the drive signal to the first electrode and when applying the drive signal to the second electrode.

The piezoelectric element may be a single-layer piezoelectric element having one piezoelectric body layer, or a stacked piezoelectric element having two or more piezoelectric body layers. In the stacked piezoelectric element, the first electrode and second electrode may be inner electrodes that are interposed between the piezoelectric bodies.

Preferably, each of the piezoelectric element is operated in a direction in which the liquid is pulled toward inside of the ejection aperture to the pressure chamber when the drive signal is applied to the first electrode, and is operated in a direction in which the liquid is pushed toward outside of the ejection aperture when the drive signal is applied to the second electrode.

That is, the drive signal having the voltage with the same polarity can be used to perform pulling and pushing (pull-push drive) that are suitable for liquid ejection.

The liquid is not ejected from the ejection aperture by the transient phenomenon of the pulling drive alone of the pushing drive alone, and the liquid is ejected from the ejection aperture if the pull-push drive is performed as a series of operations.

Preferably, a time interval between the drive signal applied to the first electrode and the drive signal applied to the second electrode is not longer than a half of a cycle of the drive signal.

According to this, the resonance cycle of the ejection elements and the cycle of the drive signal can be matched to each other, thereby improving the ejection efficiency and refilling efficiency.

The ejection elements may include a pressure chamber which contains the liquid, an ejection aperture which ejects the liquid, a supply port which supplies the liquid into the pressure chamber, and the like. In addition to these, the ejection elements may include a diaphragm (pressure plate) which changes a deformation of the piezoelectric element to mechanical displacement.

Furthermore, a mode is preferred in which if the resonance cycle of the ejection elements changes according to the type (composition, viscosity and the like) of the ejected liquid, the cycle of the drive signal is changed accordingly.

In order to attain the aforementioned object, the present invention is also directed to an image forming apparatus which comprises the above-described liquid ejection apparatus and forms a desired image on an ejection receiving medium by means of the liquid ejected from the liquid ejection apparatus.

"Ejection receiving medium" is a medium which receives droplets that are ejected from the ejection head (a medium that can be called "print medium", "medium on which an image is formed", "record receiving medium", "image receiving medium", and the like), and includes various media such as continuous paper, a cut sheet, sealing paper, a resin sheet such as an OHP sheet, a film, a fabric, a printed board on which a wiring pattern or the like is formed by the ejection head, an intermediate transfer medium, and other media regardless of materials and shapes.

Since the present invention is constituted such that the drive signal having voltage with the same polarity is sequentially applied in succession to the first electrode and the second electrode that the piezoelectric elements have, the voltage of the drive signal may have the single polarity so that the drive circuit and wiring can be simplified. Further, the drive signal is sequentially applied to the piezoelectric element in succession by delaying the timing of the application, thus, regarding a deformation amount of the piezoelectric element, a deformation amount which is larger than a deformation amount corresponding to the maximum voltage of the drive signal can be obtained by adding together the deformation amounts of respective timings.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
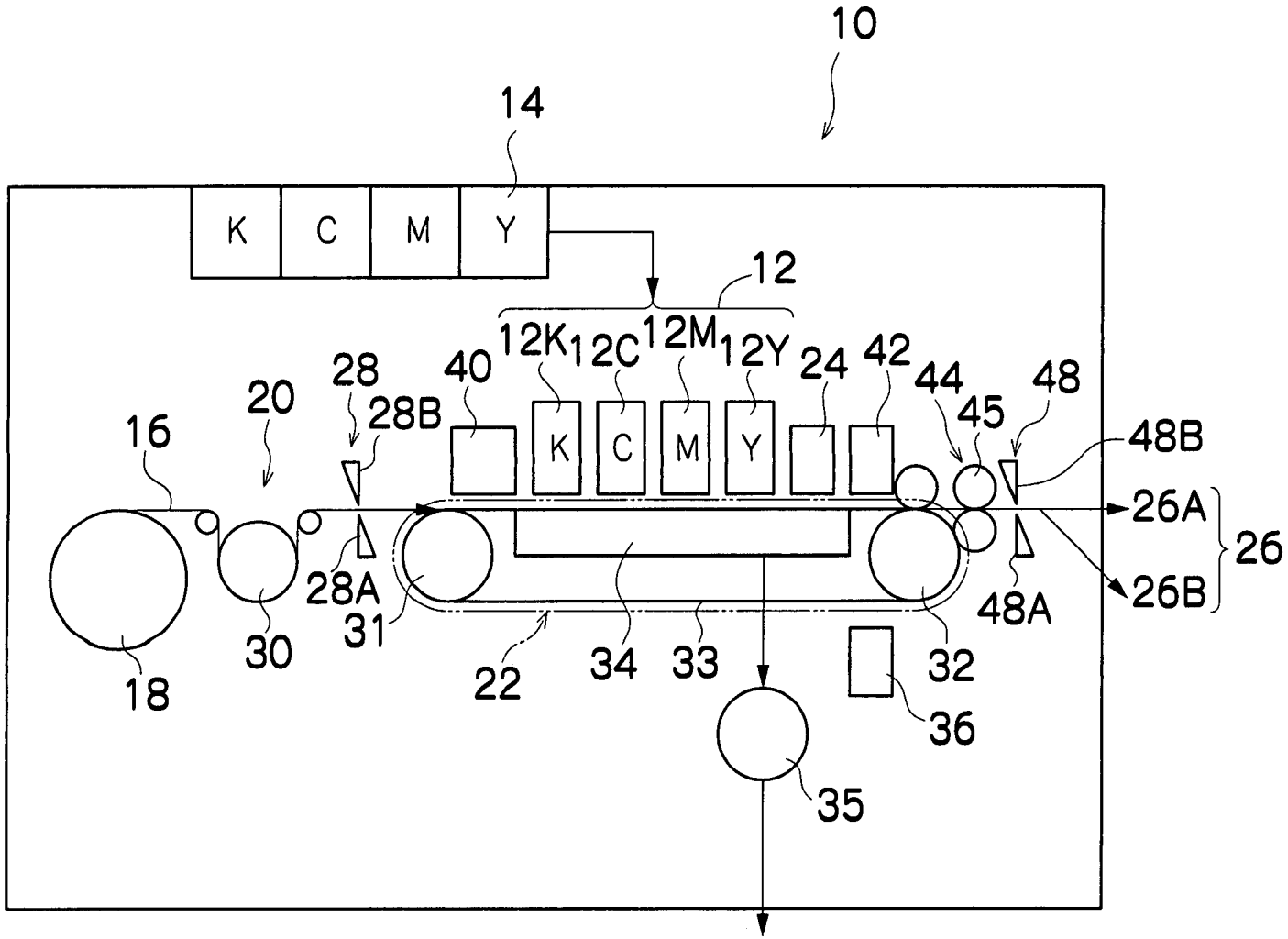
FIG. 1 is an entire configuration diagram of an inkjet recording apparatus in which is used an image processing apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of inkjet heads 12K, 12C, 12M and 12Y provided for ink colors of black (K), cyan (C), magenta (M) and yellow (Y), respectively; an ink storing and loading unit 14 for storing inks of K, C, M and Y to be supplied to the print heads 12K, 12C, 12M and 12Y; a paper supply unit 18 for supplying recording paper 16; a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there might be a problem in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
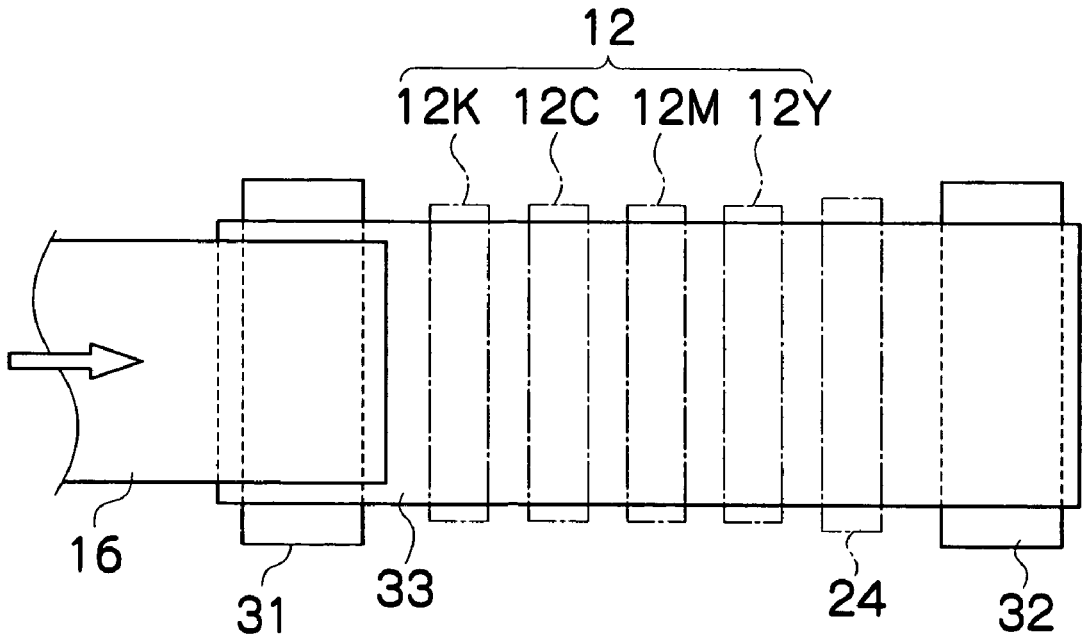
FIG. 2 is a plan view of principal components around a print unit of the inkjet recording apparatus shown in FIG. 1.

The print unit 12 is a so-called "full line head" in which a line head having a length corresponding to the maximum paper width is arranged in a direction (main scanning direction) that is perpendicular to the conveyance direction of the recording paper (sub-scanning direction) (see FIG. 2). An example of the detailed structure is described below with reference to FIGS. 3A to 5, and each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, following the feed direction of the recording paper 16 (hereinafter, referred to as the sub-scanning direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width (the entire width of the printable region) of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K, M, C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M or 12Y, via a tube channel (not illustrated). The ink storing and loading unit 14 also comprises a warning device (for example, a display device or an alarm sound generator) for warning when the remaining amount of any ink is low, and has a mechanism for preventing loading errors among the colors.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated through the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a print head will be described. The print heads 12K, 12C, 12M and 12Y provided for the respective ink colors have the same structure, and a reference numeral 50 is hereinafter designated to any of the print heads 12K, 12C, 12M and 12Y.

Figure 3A:
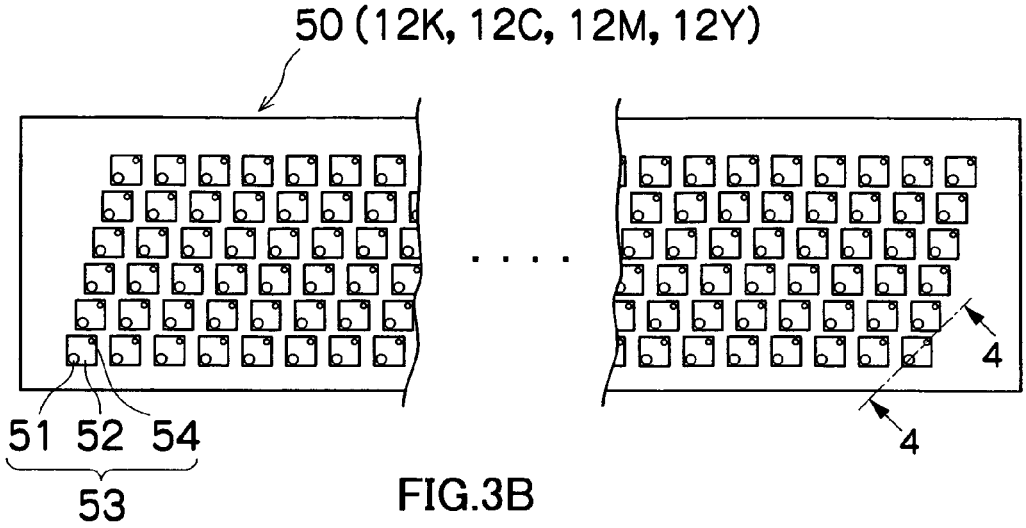
FIGS. 3A to 3C are plan perspective views which show a head of the inkjet recording apparatus shown in FIG. 1.
Figure 3B:
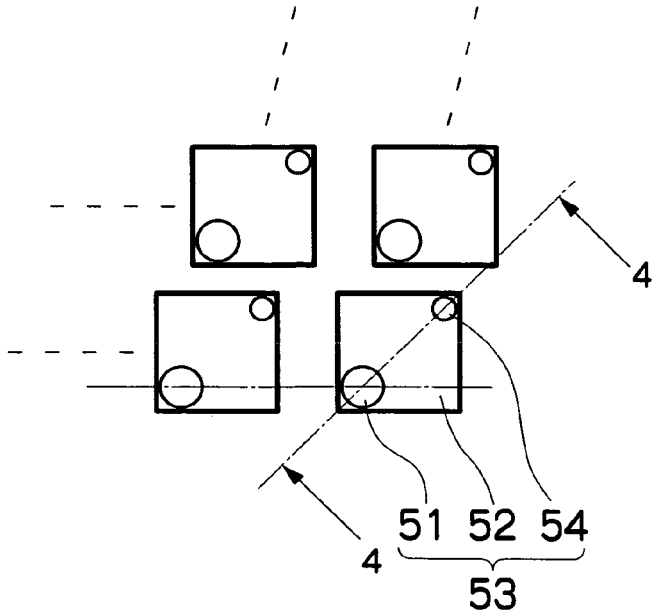
Figure 3C:
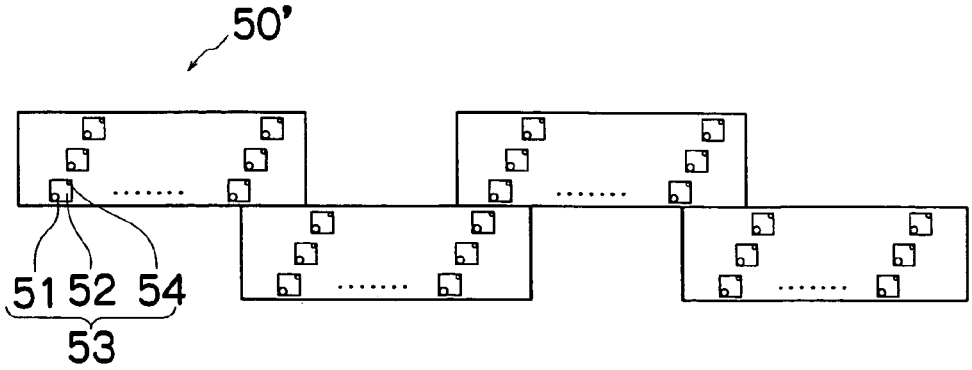
Figure 4:
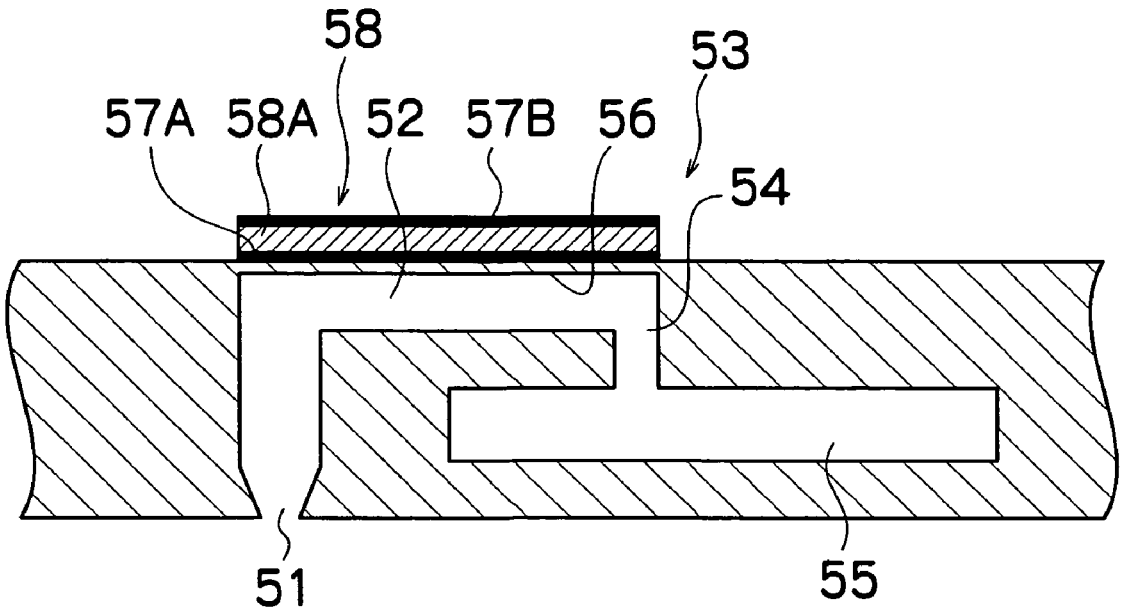
FIG. 4 is a sectional view showing a structure of the head shown in FIGS. 3A to 3C.

FIG. 3A is a plan view perspective diagram showing an example of the structure of a print head 50, and FIG. 3B is an enlarged diagram of a portion of same. Furthermore, FIG. 3C is a plan view perspective diagram showing a further example of the composition of a print head 50, and FIG. 4 is a cross-sectional diagram showing a three-dimensional composition of an ink chamber unit (being a cross-sectional view along line 4-4 in FIG. 3A). In order to achieve a high density of the dot pitch printed onto the surface of the recording medium, it is necessary to achieve a high density of the nozzle pitch in the print head 50. As shown in FIGS. 3A to 3C and FIG. 4, the print head 50 in the present embodiment has a structure in which a plurality of ink chamber units 53 (ejection elements), each comprising nozzles 51 for ejecting ink droplets and pressure chambers 52 corresponding to the nozzles 51, are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction of the recording medium.

Moreover, as shown in FIG. 3C, it is also possible to use respective heads 50' of nozzles arranged to a short length in a two-dimensional fashion, and to combine same in a zigzag arrangement, whereby a length corresponding to the full width of the print medium is achieved.

The pressure chamber 52 provided corresponding to each of the nozzles 51 is approximately square-shaped in plan view, and the nozzle 51 and a supply port 54 are provided respectively at either corner on a diagonal of the pressure chamber 52. Each pressure chamber 52 is connected via the supply port 54 to the common flow passage 55.

A piezoelectric element 58, which has a structure in which a piezoelectric body layer 58A is interposed between a first electrode 57A and a second electrode 57B, is joined with a pressure plate 56, which constitutes a top surface of the pressure chamber 52. The first electrode 57A is an electrode on the back, which is provided on the pressure plate 56 side, while the second electrode 57B is an electrode on the surface which is an opposite face of the first electrode 57A. When the pressure plate 56 is formed from a metallic material, an insulating member is provided between the pressure plate 56 and the first electrode 57A, and the insulation performance between the first electrode 57A and the pressure plate 56 is secured.

It is preferable that the piezoelectric body layer 58A is constituted so as to have a through hole to pass the wiring from the side of the first electrode 57A to the second electrode 57B. Of course, the wiring can be passed from the second electrode 57B side to the first electrode 57A. Details of the wiring structures and control of drive among the ink chamber units are described hereinafter.

When a driving voltage (drive signal) having the same polarity is sequentially applied in succession between the first electrode 57A and the second electrode 57B, the piezoelectric element 58 is deformed, and droplets of the ink are ejected from the nozzle 51. When the ink is ejected, a new ink is supplied from the common flow passage 55 to the pressure chamber 52 through the supply port 54. The detail of the drive signals with the same polarity, which are applied to the first electrode 57A and the second electrode 57B, is described hereinafter.

Figure 5:
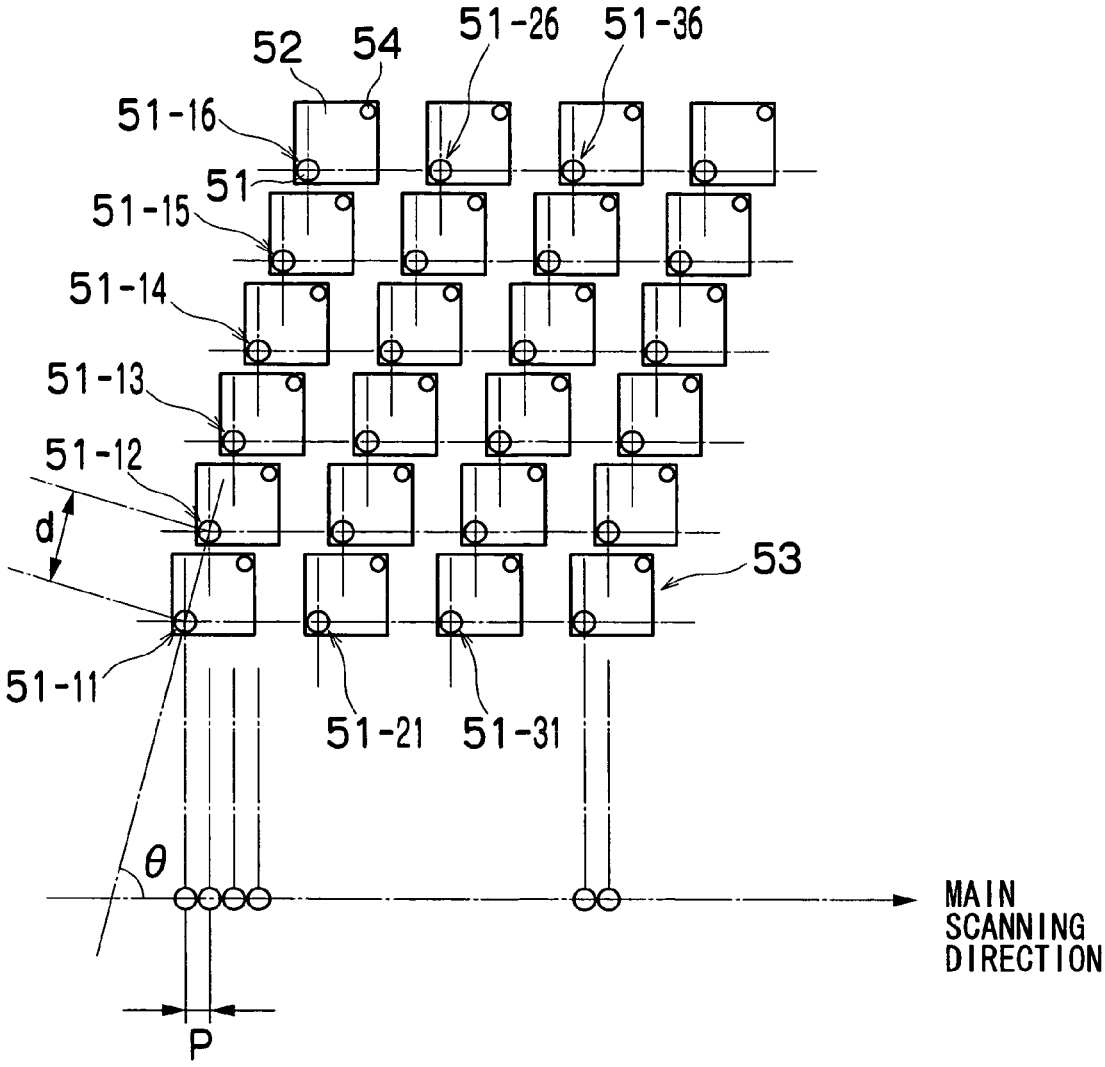
FIG. 5 is an enlarged drawing showing an arrangement of nozzles of the head shown in FIGS. 3A to 3C.

As shown in FIG. 5, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles when projected to an alignment in the main scanning direction will be $d \times \cos\theta$.

More specifically, the arrangement can be treated equivalently to one wherein the respective nozzles 51 are arranged in a linear fashion at uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

In a full-line head comprising rows of nozzles corresponding to the entire width of the image recordable width, the "main scanning" is defined as printing a line formed of a row of dots, or a line formed of a plurality of rows of dots in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of a line formed of a row of dots, or a line formed of a plurality of rows of dots, formed by the main scanning, while moving the full-line head and the recording paper relatively to each other.

The arrangement of the nozzles is not limited to the illustrated examples in the embodiments of the present invention, thus an arrangement in which the nozzles are lined up in a column direction along the main scanning direction and a row direction along the sub-scanning direction, and other various nozzle arrangements can be applied.

Further, in the present embodiment, a single-layer piezoelectric element having one piezoelectric body layer is exemplified; however, the present invention can also be applied to a multilayer piezoelectric element in which two or more piezoelectric body layers are stacked. In a multilayer piezoelectric element, electrodes having the functions of the first electrode 57A and the second electrode 57B may be the inner electrodes.

Configuration of Ink Supply System

Figure 6:
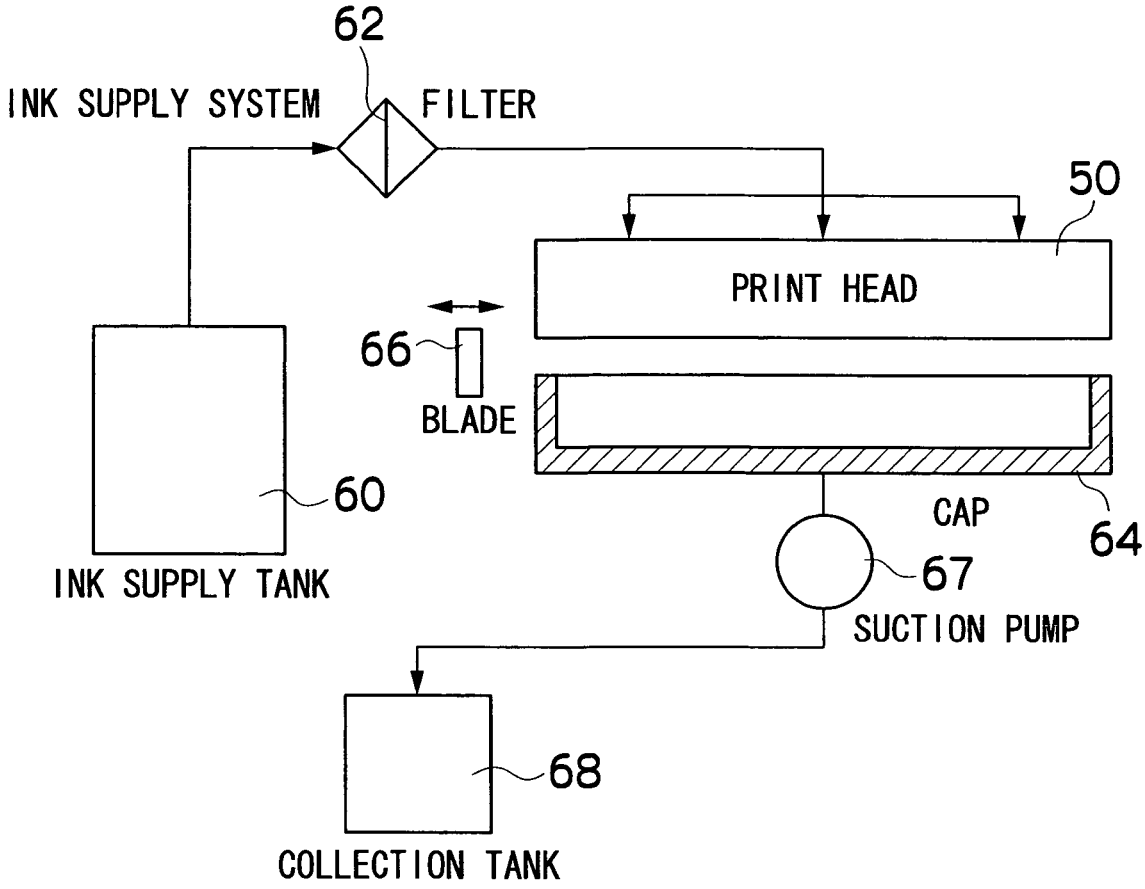
FIG. 6 is a schematic drawing showing a configuration of an ink supply system in the inkjet recording apparatus.

FIG. 6 is a schematic drawing showing the configuration of the ink supply system in the inkjet recording apparatus 10.

The ink tank 60 is a base tank that supplies ink to the head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the piezoelectric element 58 for the ejection driving is operated. Before reaching such a state (in a viscosity range that allows ejection by the operation of the piezoelectric element 58) the piezoelectric element 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the piezoelectric element 58 is operated. Also, when the ink viscosity inside the nozzle 51 has increased over a certain level, ink can no longer be ejected from the nozzle 51 even if the piezoelectric element 58 is operated. In these cases, a suctioning device to remove the ink inside the pressure chamber 52 by suction with a suction pump, or the like, is placed on the nozzle face of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
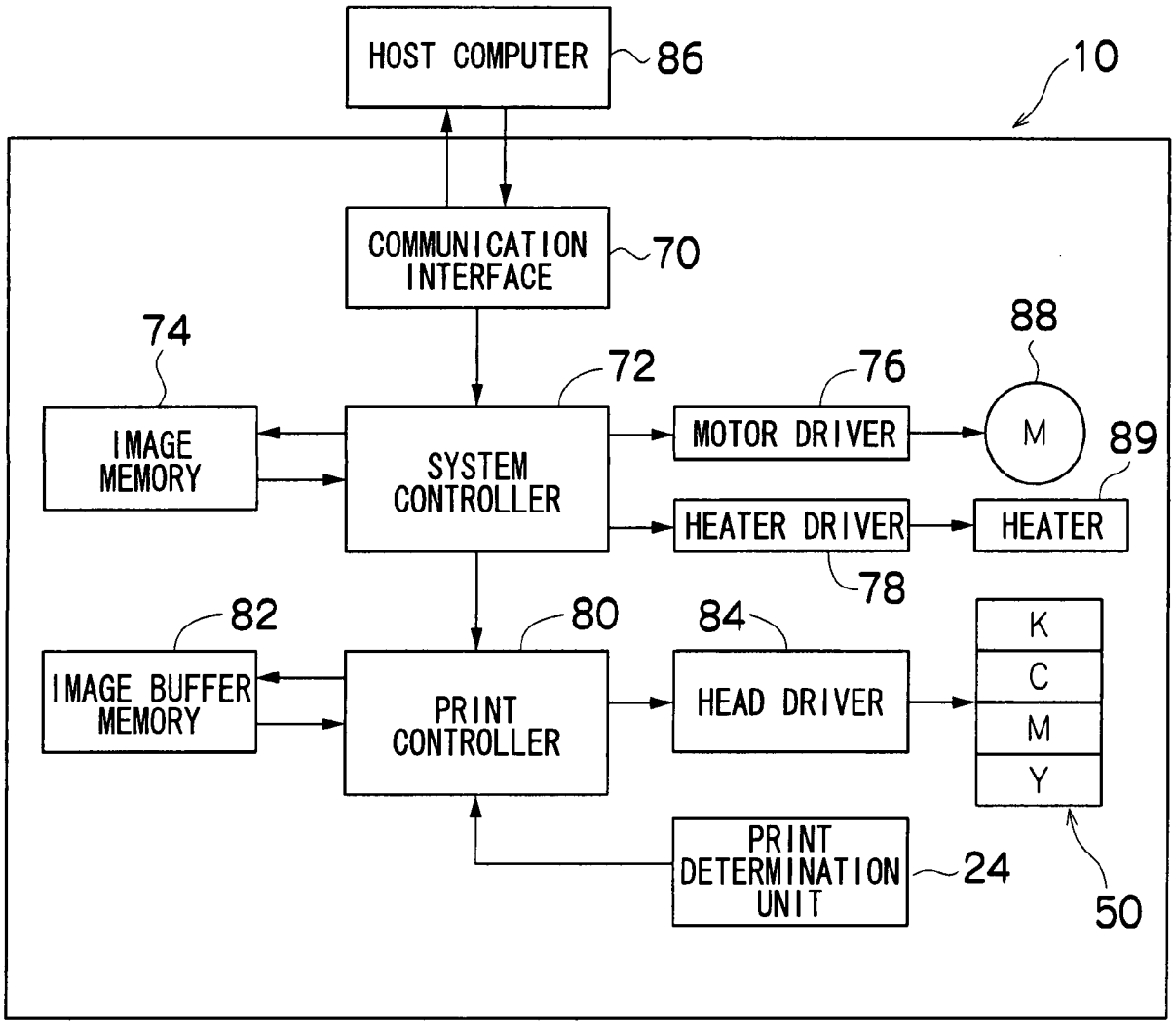
FIG. 7 is a block diagram showing a system configuration of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements 58 of the heads of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

Various control programs are stored in a program storage unit (not shown), and the control programs are read and executed in accordance with a command of the system controller 72. For the program storage unit, a semiconductor memory such as a ROM or EEPROM may be used, or a magnetic disk may be used. The program storage may have an external interface and use a memory card or a PC card. Of course the program storage unit may have a plurality of storage media of these storage media.

The program storage unit may be used along with a storage device (not shown) such as an operation parameter.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24.

In the embodiment shown in FIG. 1, the configuration is such that the print determination unit 24 is provided on the print surface side, and the print surface is illuminated by a light source (not shown) such as a cold-cathode tube disposed in the vicinity of the line sensor, and the reflected light is read by means of the line sensor. However, other configurations may be possible for the embodiments of the present invention.

Wiring Structure Between Piezoelectric Elements, and Drive Circuits of Piezoelectric Elements Next, the abovementioned wiring structure between the piezoelectric elements is now described.

Figure 8:
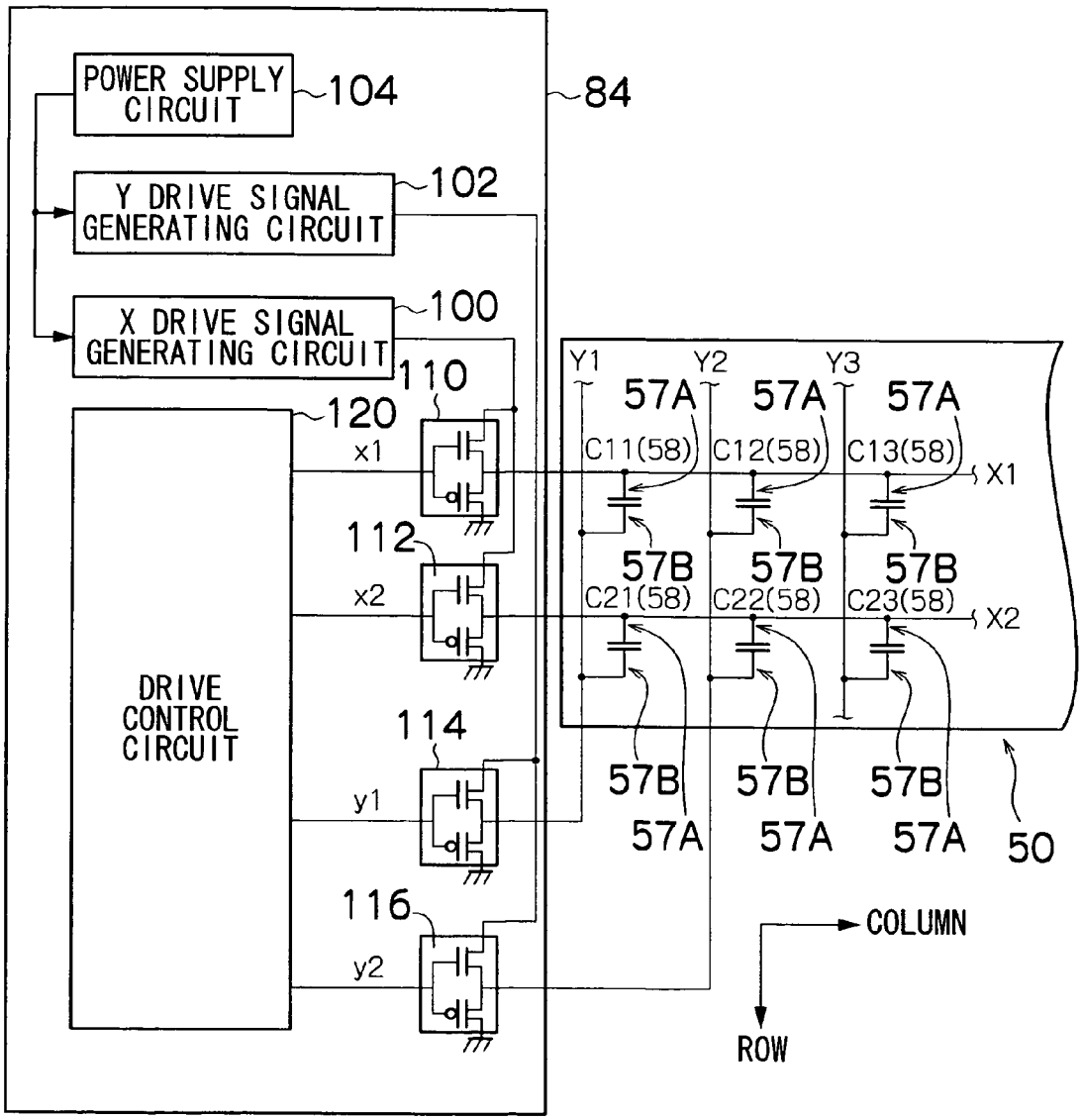
FIG. 8 is a block diagram showing the detail of the system shown in FIG. 7.

FIG. 8 is a block diagram showing a wiring structure between the piezoelectric elements 58 that the print head 50 has, and the configuration of the head driver 84, which drives the piezoelectric elements 58 shown in FIG. 7.

As shown in FIG. 8, the print head 50 has a wiring structure in which the piezoelectric elements 58 that the two-dimensionally disposed ink chamber units 53 have are connected with common signal lines X1, X2, . . . , in row directions of, for example, C11, C12, C13, . . . , or C21, C22, C23, and with common signal lines Y1, Y2, Y3, . . . , in column directions of, for example, C11, C21, . . . , or C12, C22, . . . .

More specifically, the print head 50 has a matrix wiring structure in which the electrodes (the first electrode and the second electrode) on both sides of the plurality of piezoelectric elements 58 are mutually connected so as to form rows and columns.

In FIG. 8, for the sake of convenience for the description, the condensers C11, C12, C13, C21, C22, C23, . . . correspond to the piezoelectric elements 58 equipped in the respective ink chamber units, and the first electrodes 57A of the respective piezoelectric elements are connected with the signal liens X1, X2, . . . (signal lines in the rows), and the second electrodes 57B of the respective piezoelectric elements are connected with the signal lines Y1, Y2, Y3, . . . (signal lines in the columns).

Further, FIG. 8 shows the print head 50 in which the ink chamber units 53 are arranged in two rows and three columns; however, the print head 50 is actually provided with more of the ink chamber units 53 as shown in FIGS. 3A to 3C.

The head driver 84, which is a drive circuit for the piezoelectric elements 58 equipped in the print head 50 with such a wiring structure, comprises: an X drive signal generating circuit (drive signal generating circuit) 100, which generates a drive signal (driving wave) transmitted by the signal lines X1, X2, . . . ; a Y drive signal generating circuit (drive signal generating circuit) 102, which generates a drive signal transmitted by the signal lines Y1, Y2, Y3, . . . ; a power supply circuit 104, which is a power source (power source for a drive signal applied to the piezoelectric element) of the X drive signal generating circuit 100 and the Y drive signal generating circuit 102; complementary transistor pairs (switching devices) 110, 112, 114, 116, . . . , which are respectively provided for the signal lines in the rows and the signal lines in the columns, and which switch ON and OFF the drive signals for the respective signal lines; and a drive control circuit (drive controlling device) 120, which generates a drive control signal provided to the complementary transistor pairs 110 to 116.

The X drive signal generating circuit 100 and the Y drive signal generating circuit 102 have the same structure, and each of them comprises: a signal generating unit, which generates waves for the drive signals; an amplification unit (level shift unit), which amplifies the voltage of the waveform generated by the signal generating unit to a level of voltage applied to the piezoelectric element 58 (shifts the voltage levels); and an output unit, which outputs the amplified drive signals.

The power supply circuit 104 is a voltage source which generates a voltage with a single polarity, and is a power source of the drive signals transmitted from the X drive signal generating circuit 100 and the Y drive signal generating circuit 102. Therefore, the abovementioned drive signals have the voltage with a single polarity.

In FIG. 8, for the complementary transistor pairs 110 to 116 that are the switching elements (switching device), transistor arrays in which is configured a push pull circuit where the transistors are serially connected in one element. However, a similar circuit may be configured using separate transistors such that, for example, complementary transistors are serially connected. Of course, types of the transistors are not limited, and any of the bipolar type, the field-effect type, etc. can be used.

Figure 9:
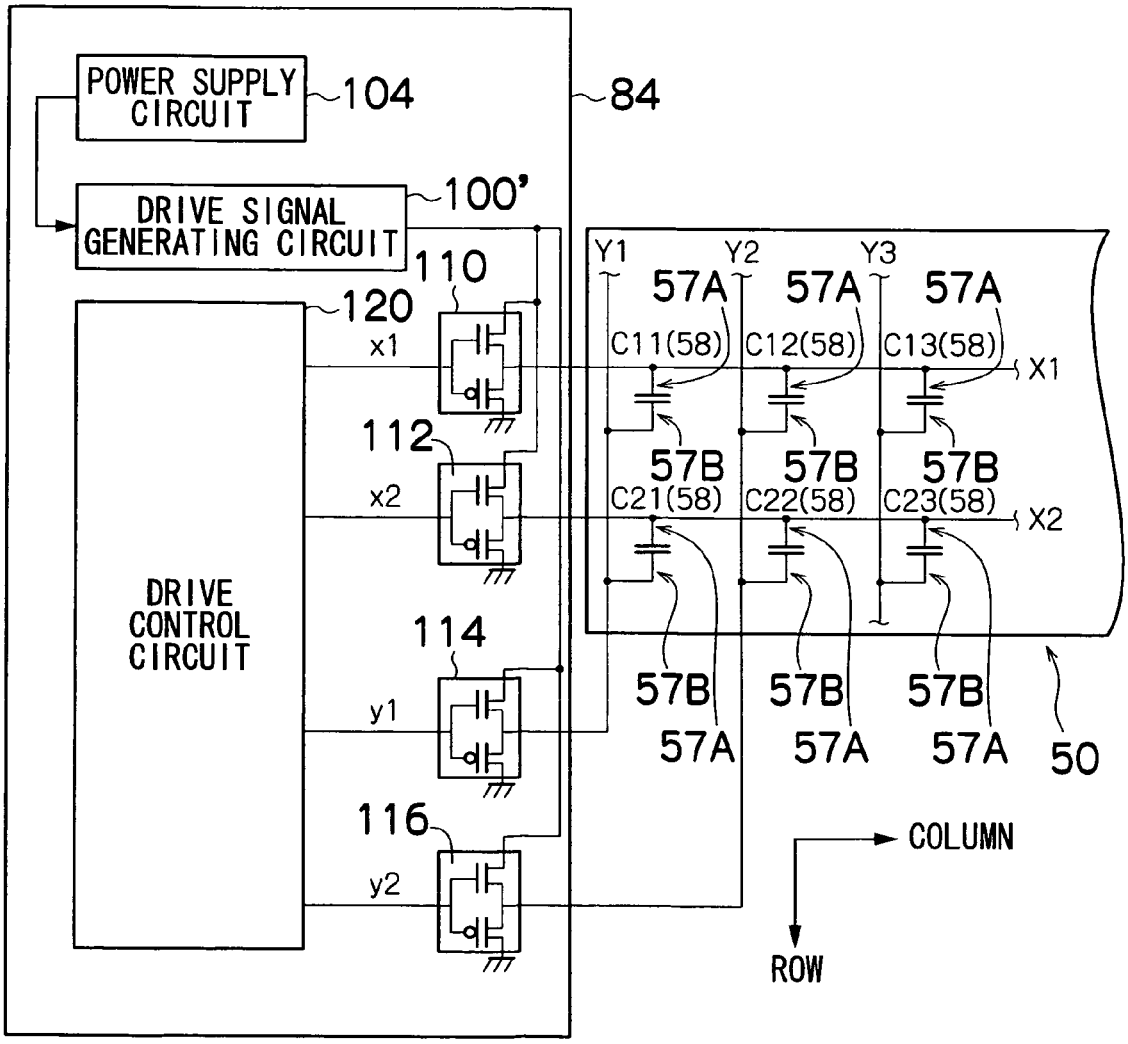
FIG. 9 is a block diagram showing another mode of the system shown in FIG. 8.

As shown in FIG. 9, it is also preferable that the head driver 84 has a drive signal generating circuit 100', which serves as both the X drive signal generating circuit 100 and the Y drive signal generating circuit 102, to send a common drive signal to the signal lines in the rows (X rows) and the columns (Y columns).

The principle of operation of the complementary transistor pairs 110 to 116 is explained with reference to FIG. 10. The transistor pairs 110 to 116 have the same structure, and the transistor pair 110 is used for the explanation here.

Figure 10:
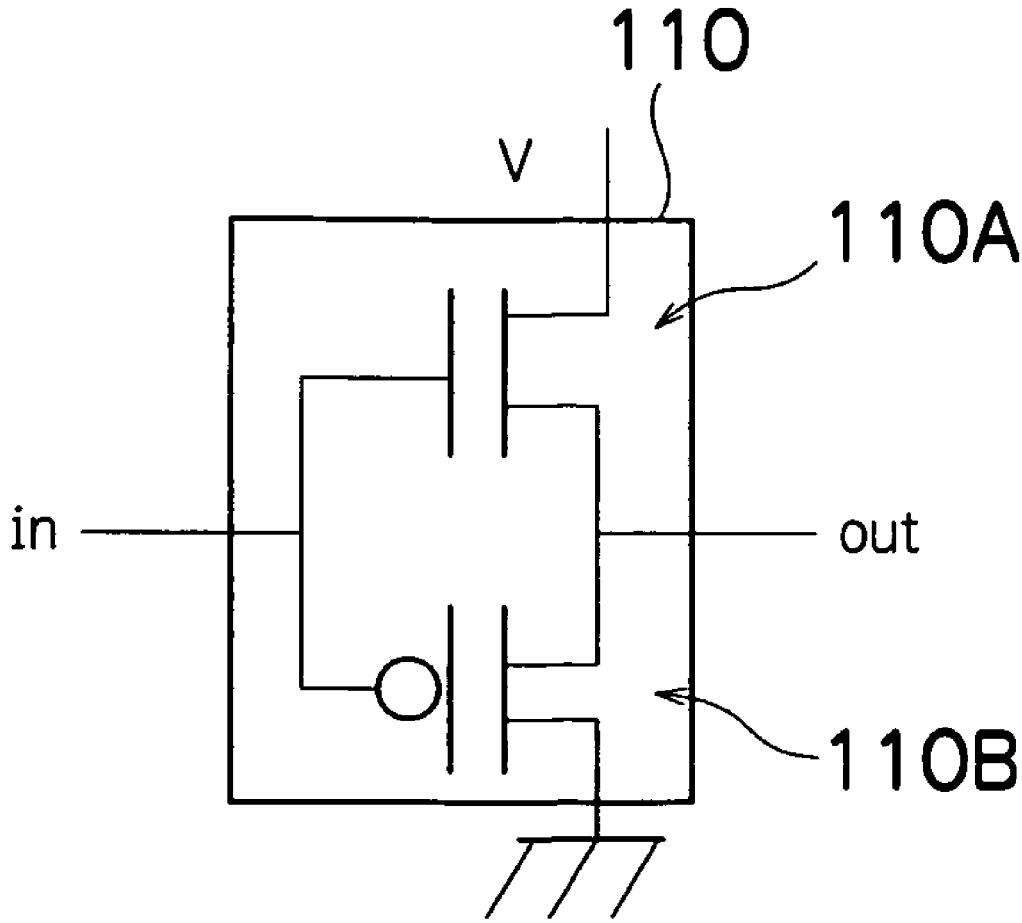
FIG. 10 is a drawing for explaining the principle of operation of the transistors shown in FIGS. 8 and 9.

As shown in FIG. 10, in the transistor pair 110, a transistor 110A is serially connected to a transistor 110B, a base (in) which is a signal input terminal of the transistors 110A and 110B, and a collector or emitter (out) which is an output terminal are shared by the transistors 110A and 110B, the remaining terminal of the transistor 110A (emitter or collector) is connected to the power supply (V), and the remaining terminal of the transistor 110B (emitter or collector) is connected to the ground potential (reference potential).

When a low-level signal is applied to the signal input terminal, the transistor 110A is turned OFF and the transistor 110B is turned ON, so that the output terminal is connected to the ground potential. On the other hand, when a high-level signal is applied to the signal input terminal, the transistor 110A is turned ON and the transistor 110B is turned OFF, so that the output terminal is connected to the power supply. In this manner, switching ON and OFF of the output terminal is controlled by the logic of the control signals applied to the signal input terminal.

The complementary transistor pairs 110 to 116 shown in FIGS. 8 and 9 selectively switch between the drive signals that can be obtained from the X drive signal generating circuit 100 or the Y drive signal generating circuit 102 and the ground potential by means of the drive control signals (selection signals) sent from the drive control circuit 120, and then apply the drive signals to the piezoelectric elements 58 that are selected at a desired timing.

In FIG. 8, there is separately provided the X drive signal generating circuit 100 generating the drive signals (driving wave) prepared to the signal lines X1, X2, . . . , and the Y drive signal generating circuit 102 generating the drive signals provided to the signal lines Y1, Y2, Y3, . . . . It is also preferable to provide, as shown in FIG. 9, the single drive signal generating circuit 100' serving as both the X drive signal generating circuit 100 and the Y drive signal generating circuit 102 to prepare the drive signals having the common waveform to the signal lines X1, X2, . . . and the signal lines Y1, Y2, Y3, . . . .

Driving Method of Piezoelectric Elements

Hereinafter there is described an example of method for selectively driving a desired piezoelectric element using the head driver 84 and the signal lines X1, X2, . . . and the signal lines Y1, Y2, Y3, . . . that have the configurations as shown in FIG. 8 or 9. A method for driving the piezoelectric element C11 is illustrated here.

Figure 11A:
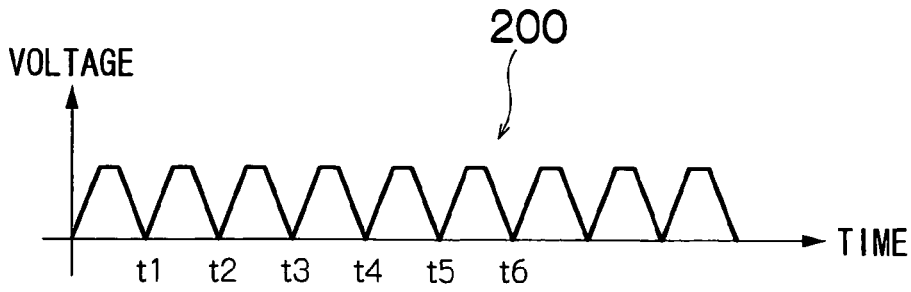
FIGS. 11A to 11C are drawings for explaining drive signals of a piezoelectric element shown in FIG. 4.
Figure 11B:
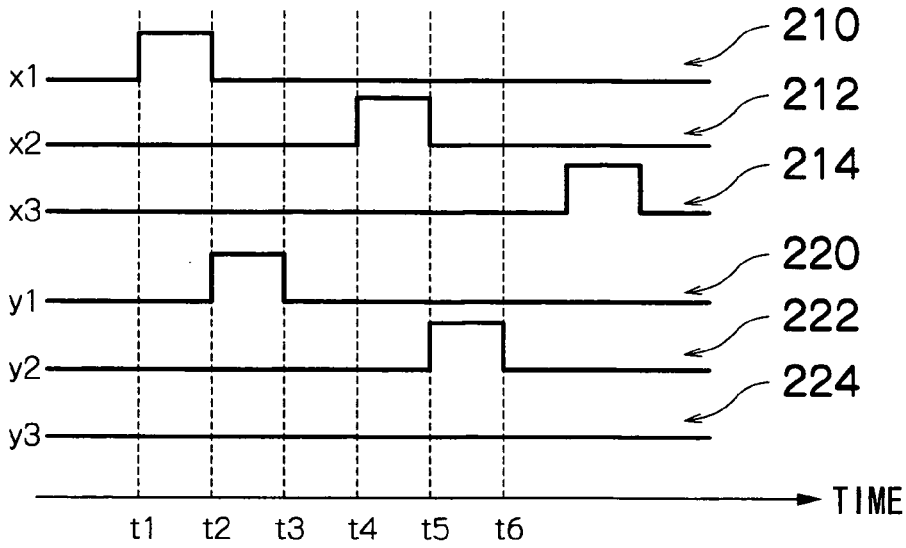

FIG. 11A shows a common drive signal 200, which is generated by the X drive signal generating circuit 100, the Y drive signal generating circuit 102 shown in FIG. 8 and the drive signal generating circuit 100' shown in FIG. 9, and applied to the V-terminal of the complementary transistor pair shown in FIG. 10. FIG. 11B shows drive control signals 210 to 224, which are applied from the drive control circuit to the signal inputs of the complementary transistor pairs 110 to 116. FIG. 11 C shows drive signals 240 to 252, which are transmitted through the signal lines X1, X2, . . . and Y1, Y2, . . . and applied to the piezoelectric elements that are selected at desired timings.

Figure 11C:
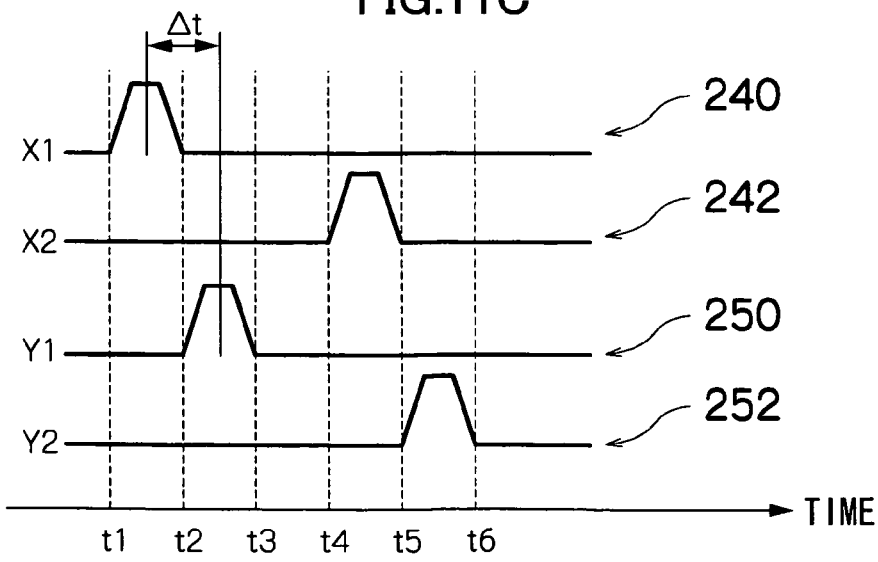
Figure 12:
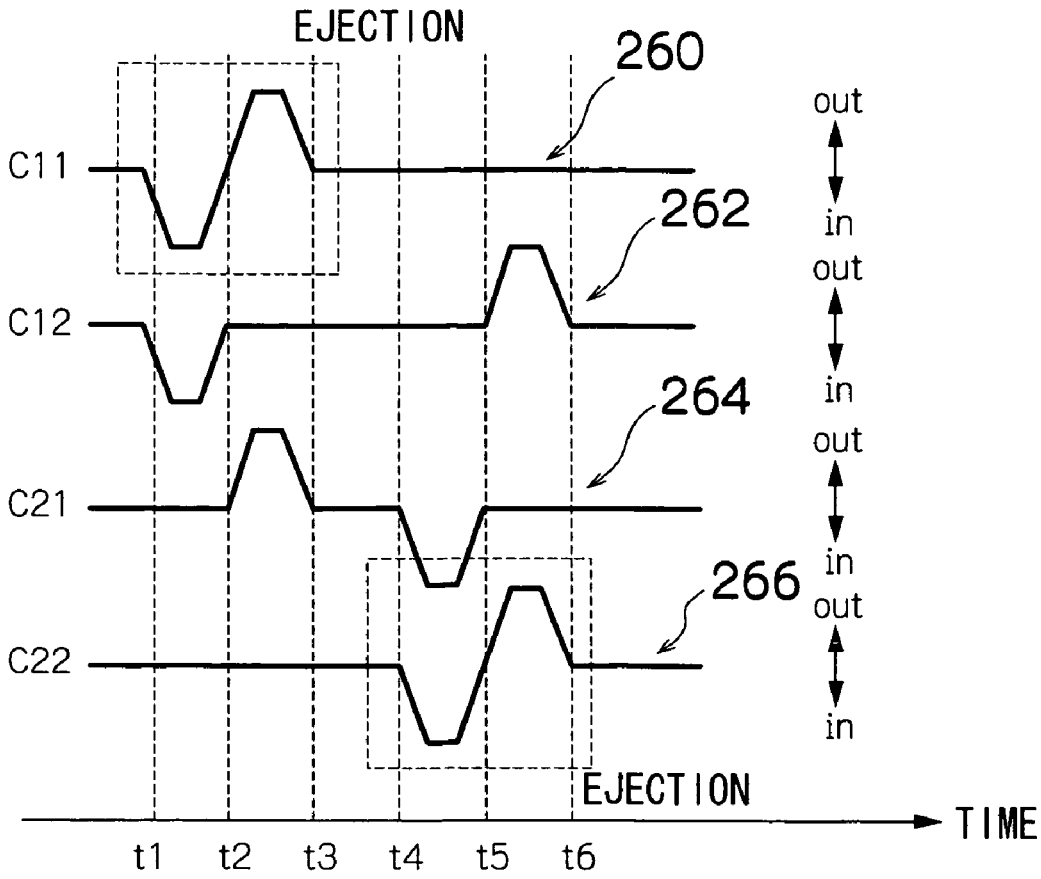
FIG. 12 is a drawing showing a deformation of the piezoelectric element driven by the drive signals shown in FIGS. 11A to 11C.

FIG. 12 shows a deformation 260 of the piezoelectric element C11, a deformation 262 of the piezoelectric element C12, a deformation 264 of the piezoelectric element C21, and a deformation 266 of the piezoelectric element C22, when the drive signals 240 to 252 shown in FIG. 11C are applied. In FIG. 12, the direction shown as "out" indicates a direction in which the ink is pushed toward the outside of the nozzle, and the direction shown as "in" indicates a direction in which the ink is pulled toward the inside of the nozzle.

In FIGS. 11A to 12, the horizontal axes show time axes, on which the same reference numerals are given to the same timings.

As shown in FIG. 11A, the common drive signal 200 has a plurality of continuous trapezoid waveforms, and is time-divided in accordance with the drive signal application timings of the piezoelectric elements, whereby the drive signals (drive signals 240 to 252 shown in FIG. 11C) applied to the piezoelectric elements at desired timings are generated. Although FIG. 11A shows a mode where the waveforms in the same shape continue, it is also preferable that the configuration shown in FIG. 8 is applied to obtain the common drive signal 200 having waveforms in different shapes connected. Moreover, the shape of the waveforms is not limited to a trapezoid, and can be a triangle or square.

For example, the drive control signal 210, which is applied to the signal input terminal of the complementary transistor pair 110, becomes a high-level signal during a period between a timing t1 and a timing t2, and becomes a low-level signal during other periods. When the transistor pair 110 is operated according to the drive control signal 210, the drive signal 240 transmitted through the signal line X1 is generated.

Similarly, the drive control signal 220, which is applied to the signal input terminal of the transistor pair 114, becomes the high-level signal during a period between the timing t2 and a timing t3, and becomes the low-level signal during other periods. When the transistor pair 112 is operated according to the drive control signal 220, the drive signal 250 transmitted through the signal line Y1 is generated.

Moreover, the drive control signal 212, which is applied to the signal input terminal of the transistor pair 112, and the drive control signal 222, which is applied to the signal input terminal of the transistor pair 116, become the high-level signal during a period between a timing t4 and a timing t5, and a period between the timing t5 and a timing t6, respectively, and becomes the low-level signal during other periods. If the transistor pairs 112 and 116 are operated according to these drive control signals 212 and 222, the drive signals 242 and 252 transmitted through the signal lines X2 and Y2 are generated, respectively.

Next, the drive signals 240 to 252 generated in the above-described manner are used to explain, step by step, the driving method for driving desired piezoelectric elements. Here, the method for driving the selected piezoelectric element C11 is described.

Step 1: A drive signal is applied to a piezoelectric element in a row (signal line X1) having the piezoelectric element C11. More specifically, during the period between the timing t1 and the timing t2, the drive control signal 210 applied to the transistor pair 110 becomes the high-level signal, and the signal obtained by time-dividing the common drive signal 200 (one of the trapezoidal waveform signals) is applied to the first electrodes 57A of the piezoelectric elements C11, C12, C13, . . . connected to the signal line X1.

Step 2: On the other hand, during the period between the timing t1 and the timing t2, the drive control signal 220 applied to the transistor pair 114 becomes the low-level signal, and the second electrode 57B of the piezoelectric element C11 becomes the ground potential. Therefore, in the period between the timing t1 and the timing t2, the drive signal of the trapezoid is applied to the first electrode 57A of the piezoelectric element C11, the second electrode 57B becomes the ground level, the drive signal 240 with a predetermined polarity where the second electrode 57B is the reference potential is applied to the first electrode 57A, and the piezoelectric element C11 is thereby driven in the direction in which the ink is pulled in.

In the period between the timing t1 and the timing t2, as with the piezoelectric element C11, in the piezoelectric elements C12 and C13 (in other words, the piezoelectric elements in which the signal line X1 is connected to the first electrodes 57A), the drive signal 240 where the second electrode 57B is the reference potential is applied to the first electrodes 57A.

Here, the polarity of the drive signal and a polarization direction of the piezoelectric element are determined such that the piezoelectric element is driven in a direction where the ink is pulled into the nozzle when the drive signal with a positive polarity is given to the first electrode 57A taking the second electrode 57B as the reference potential. Moreover, the voltage (amplitude) of the drive signal 240 is as much as the ink ejection does not occur with the drive signal by itself.

Step 3: A drive signal is applied to only a column (signal line Y1) having the piezoelectric element C11. More specifically, in the period between the timing t2 and the timing t3, the drive control signal 220 applied to the transistor pair 114 becomes the high-level signal, and the signal obtained by time-dividing the common drive signal 200 (one of the trapezoidal waveform signals) is applied to the second electrodes 57B of the piezoelectric elements C11, C21, . . . connected to the signal line Y1.

Step 4: On the other hand, in the period between the timing t2 and the timing t3, the drive control signal 220 applied to the transistor pair 110 becomes the low-level signal, and the first electrode 57A of the piezoelectric element C11 becomes the ground potential.

In this manner, in the period between the timing t2 and the timing t3, the first electrode 57A of the piezoelectric element C11 becomes the ground level, and the drive signal is applied to the second electrode 57B of the piezoelectric element C11. More specifically, taking the first electrode 57A as the reference potential, the drive signal 250 with the same polarity as that of the drive signal 240 applied to the first electrode 57A in Step 1 is applied to the second electrode 57B.

In Step 3, however, since the electrode to which the drive signal 250 is applied is switched from the electrode to which the drive signal 240 is applied in Step 1, the piezoelectric element C11 is driven in the direction in which the ink is pushed out, as shown in FIG. 12. Of course, the voltage of the drive signal 250 (also the drive signal 240) is as much as the ink ejection does not occur by the drive signal 250 by itself.

In this manner, Step 1 and Step 2 are successively executed to sequentially apply the drive signals with the same polarity to the selected piezoelectric element in succession by delaying the timing of the application, while switching at the desired timing the electrode to which the drive signal is applied and the electrode as the reference potential, whereby the piezoelectric element C11 can obtain a deformation having a sum of the magnitude (speed) of the deformation obtained in Steps 1 and 2 and the magnitude of the deformation obtained in Steps 3 and 4, as indicated with the reference numeral 260 in FIG. 12, and an ink droplet can be ejected from the nozzle corresponding to the piezoelectric element C11.

As described above, the applied voltages in the rows and the columns are set, such that: the deformation in the piezoelectric element with the voltage applied in only the row or the voltage applied in only the column does not exceed a threshold value of the ink ejection and the ink is not ejected; on the other hand, when the deformation of the piezoelectric element can be obtained by adding the applied voltage in the row to the applied voltage in the column, the threshold value of the ink ejection is exceeded and thereby the ink is ejected.

Similarly, in the case of the piezoelectric element C22, in the period between the timing t4 and the timing t5, the drive signal 242 shown in FIG. 11C is applied to the first electrode 57A as described in Step 1 above, and in the period between the timing t5 and the timing t6, the drive signal 252 is applied to the second electrode 57B, so that the deformation shown with the reference numeral 266 in FIG. 12 can be obtained, whereby an ink droplet can be ejected from the nozzle corresponding to the piezoelectric element C22.

The piezoelectric element C12 is deformed as shown with the reference numeral 262 in FIG. 12 in the period between the timing t1 and the timing t6; however, is not deformed continuously in the order of the pull-in drive and the push-out drive (more specifically, the drive signal 240 applied to the first electrode 57A and the drive signal 252 applied to the second electrode 57B are not continuously applied in succession), thus no ink droplet is ejected from the nozzle corresponding to the piezoelectric element C12. Similarly, the piezoelectric element C21 is deformed as shown with the reference numeral 264 in FIG. 12 in the period between the timing t1 and the timing t6; however, no ink droplet is ejected from the nozzle corresponding to the piezoelectric element C21.

More specifically, ink ejection is possible when the interval between the drive signal that operates each piezoelectric element in the direction in which the ink is pulled in and the drive signal that operates same in the direction in which the ink is pushed out does not exceed the half of the cycle of the common drive signal 200. It is more preferable that this interval is zero.

Moreover, if the drive signal with which the ink is not ejected is applied to operate the piezoelectric element, the ink inside the nozzle or in the vicinity of the nozzle is stirred, whereby it is possible to expect an effect of preventing increase of the viscosity of the ink inside the nozzle or in the vicinity of the nozzle.

Furthermore, in order to locate a meniscus static position in the nozzle, it is possible that the ground potential of each drive signal is offset to take the reference potential as a potential which is not the ground potential (in other words, 0V).

The interval ($\Delta t$ in FIG. 11C) between the drive signal in the row (for example, the drive signal 240) and the drive signal in the column (for example, the drive signal 250) that are applied in succession for ejecting the ink, is preferably equal to or less than the half of the resonance cycle of the ink chamber unit 53. A more preferred mode is $\Delta t = T/2$.

The resonance cycle of the ink chamber unit 53 is determined according to the length of the flow path and the opening area of the nozzle 51, the shape and size of the pressure chamber 52, the length of the flow path and the opening area of the supply port 54, the viscosity and type of the ink, and the like. In order to increase the ejection speed and refilling speed, it is preferable that the ink chamber units 53 are configured and the ejection cycle (ejection frequency) is set so that the ejection cycle becomes the half of the resonance cycle T of the ink chamber units 53.

According to the above-described driving method of piezoelectric elements, when the voltages applied to the first electrode and the second electrode of each piezoelectric element are equal to each other, it is possible to obtain a deformation that can be obtained when applying a voltage that is twice the above applied voltages. More specifically, each of the piezoelectric elements can obtain a deformation obtained by adding a deformation that can be obtained by the maximum voltage of the drive signal applied to the first electrode and a deformation that can be obtained by the maximum voltage of the drive signal applied to the second electrode.

Figure 13:
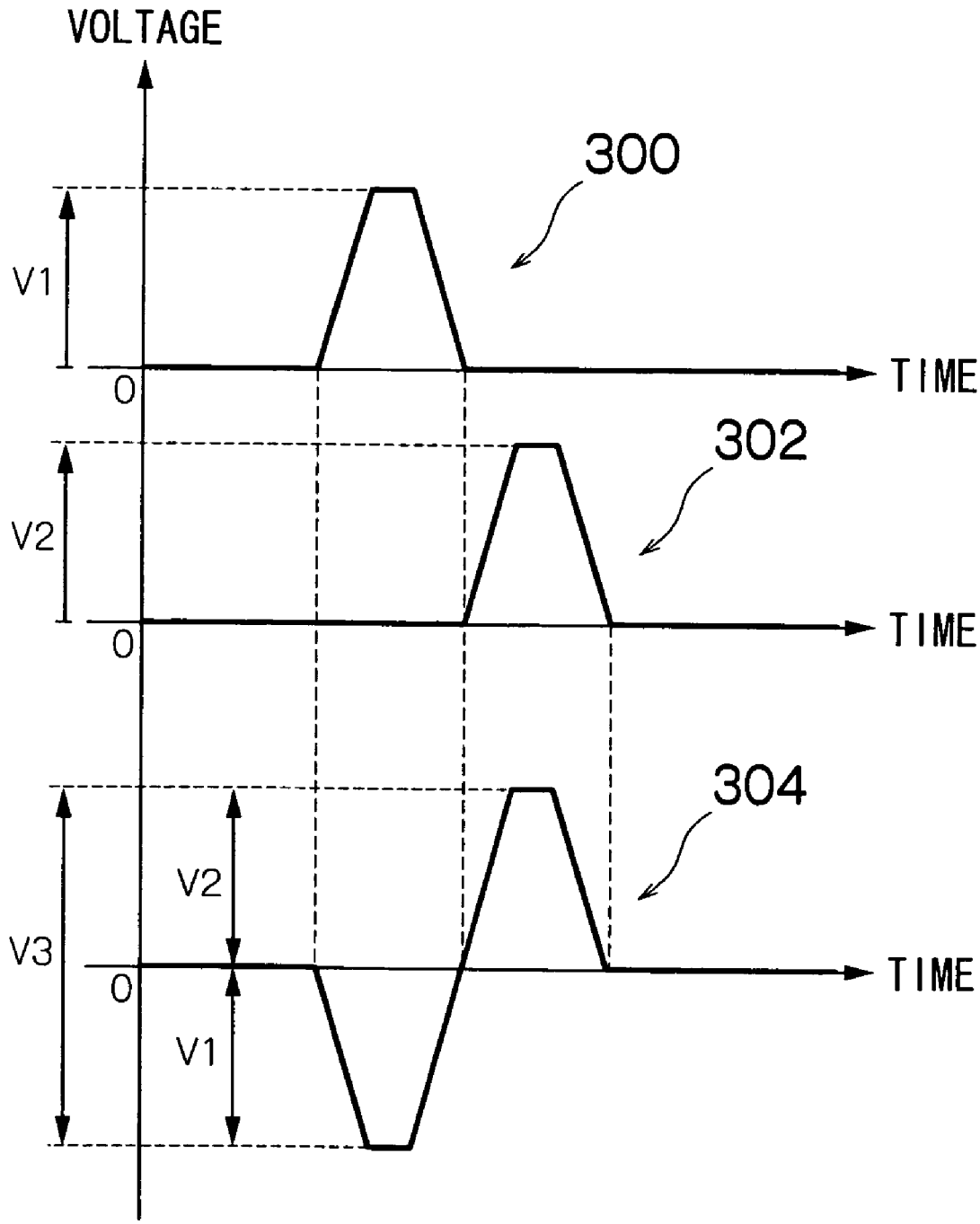
FIG. 13 is a drawing for explaining a withstanding voltage with respect to the drive signals shown in FIGS. 11A to 11C.

For example, as shown in FIG. 13, when the maximum voltage of a drive signal 300 applied to the row is V1, and the maximum voltage of a drive signal 302 applied to the column is V2, the maximum voltage V3 of a drive signal 304 when sequentially applying the drive signals 300 and 302 in succession is V1+V2. Here, in the case of V=V2=V, V3=2×V is obtained.

On the other hand, if the maximum voltages applied to the piezoelectric elements during the respective periods are V1 and V2, and when V1=V2=V is established, the V is sufficient for the withstanding voltage of each of the piezoelectric elements.

More specifically, when applying the driving method of piezoelectric elements according to the present invention, it is possible to obtain a deformation that is obtained when applying a voltage larger than the withstanding voltage of the piezoelectric element to be used, and further, for a piezoelectric element having the same withstanding voltage per thickness, a thinner piezoelectric element can be used. When driving the piezoelectric element in a flexing mode, a generation force of the piezoelectric element can be increased.

In the inkjet recording apparatus 10 configured as described above, any of the piezoelectric elements 58 can be selectively driven for applying pressure to the ink without being equipped with the switching element for controlling the driving for each of the piezoelectric elements, so that the drive circuit can be simplified, contributing in reduction of wiring.

Moreover, the drive signals with the same polarity are sequentially applied to a selected piezoelectric element while switching the electrodes thereof to which the drive signals are applied, instead of simultaneously applying the drive signals having positive and negative polarities to the both electrodes of the selected piezoelectric element, so that the power supply circuit and the drive circuit can be simplified, and the drive signal generating circuit can be shared for the rows and columns.

Furthermore, the single polarity power supply can be used as the power supply for the drive signals, and the piezoelectric elements 58 can obtain the deformation corresponding to a voltage that is twice the actually applied voltage (i.e., the deformation larger than the deformation induced by the voltage of the drive signal actually applied to the electrodes). Therefore, even when using a piezoelectric element having a withstanding voltage that is half the voltage required for obtaining a desired deformation, the desired deformation can be obtained.

The above description illustrates an inkjet recording apparatus as an example of a liquid ejection apparatus. However, the applicable scope of the present invention is not limited to the above description, thus the present invention can be applied to various image forming apparatuses and liquid ejection apparatuses for ejecting liquid onto an ejection receiving medium to form a three-dimensional form on the ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A drive circuit which drives a plurality of piezoelectric elements connected in a matrix connection, each of the piezoelectric elements having a first electrode and a second electrode, the drive circuit comprising:

a drive signal generating device which generates a drive signal with voltage of a single polarity to be applied to the piezoelectric elements;

a drive controlling device which controls a timing for applying the drive signal to each of the piezoelectric elements; and a plurality of switching devices which apply the drive signal to the piezoelectric elements according to control of the drive controlling device, a number of the plurality of switching devices being smaller than a number of the plurality of piezoelectric elements, wherein the drive controlling device applies a composite drive signal to one of the piezoelectric elements to successively operate the one of the piezoelectric elements in directions opposite to each other by setting the second electrode of the one of the piezoelectric elements to a reference potential while applying the drive signal with voltage of the single polarity to the first electrode of the one of the piezoelectric elements and then setting the first electrode of the one of the piezoelectric elements to the reference potential while applying the drive signal with voltage of the single polarity to the second electrode of the one of the piezoelectric elements in succession.

2. The drive circuit as defined in claim 1, wherein in the matrix connection the first electrodes are connected in one of a row direction and a column direction, and the second electrodes are connected in another of the row direction and the column direction.

3. The drive circuit as defined in claim 1, wherein a time interval between the drive signal applied to the first electrode and the drive signal applied to the second electrode is not longer than a half cycle of the drive signal.

4. The drive circuit as defined in claim 1, wherein the voltage of the drive signal is as much as a complete operation of each of the piezoelectric elements does not occur with the drive signal alone.

5. The drive circuit as defined in claim 1, wherein the drive signal has a waveform including an upwardly sloping part and a downwardly sloping part.

6. The drive circuit as defined in claim 1, wherein:

the drive signal includes a row line drive signal having a plurality of waveform elements and a column line drive signal having another plurality of waveform elements;

the drive signal generating device includes a row line drive signal generating device generating the row line drive signal and a column line drive signal generating device generating the column line drive signal; and the switching devices select one of the waveform elements of the row line drive signal to be applied to the first electrodes through a row signal line, and select one of the waveform elements of the column line drive signal to be applied to the second electrodes through a colunm signal line.

7. The drive circuit as defined in claim 1, wherein:

the drive signal has a plurality of waveform elements; and the switching devices select one of the waveform elements to be applied to the first electrodes through a row signal line, and select another one of the waveform elements to be applied to the second electrodes through a column signal line.

8. A driving method of driving a plurality of piezoelectric elements connected in a matrix connection, each of the piezoelectric elements having a first electrode and a second electrode, the method comprising the steps of:

generating a drive signal with voltage of a single polarity to the applied to the piezoelectric elements;

controlling a timing for applying the drive signal to each of the piezoelectric elements; and operating successively one of the piezoelectric elements in directions opposite to each other by setting the second electrode of the one of the piezoelectric elements to a reference potential while applying the drive signal with voltage of the single polarity to the first electrode of the one of the piezoelectric elements and then setting the first electrode of the one of the piezoelectric elements to the reference potential while applying the drive signal with voltage of the single polarity to the second electrode of the one of the piezoelectric elements in succession according to control of the drive controlling device with a plurality of switching devices, a number of the plurality of switching devices being smaller than a number of the plurality of piezoelectric elements.

9. The driving method as defined in claim 8, wherein the voltage of the drive signal is as much as a complete operation of each of the piezoelectric elements does not occur with the drive signal alone.

10. The driving method as defined in claim 8, wherein the drive signal has a waveform including an upwardly sloping part and a downwardly sloping part.

11. The driving method as defined in claim 8, wherein:

the drive signal includes a row line drive signal having a plurality of waveform elements and a column line drive signal having another plurality of waveform elements; and the operating step includes the step of selecting one of the waveform elements of the row line drive signal to be applied to the first electrodes through row signal line, and selecting one of the waveform elements of the column line drive signal to be applied to the second electrodes through a column signal line.

12. The driving method as defined in claim 8, wherein:

the drive signal has a plurality of waveform elements; and the operating step includes the step of selecting one of the waveform elements to be applied to the first electrodes through a row signal line, and selecting another one of the waveform elements to be applied to the second electrodes through a column signal line.

13. A liquid ejection apparatus, comprising:

an ejection head which includes: a plurality of ejection apertures through which liquid is ejected; a plurality of pressure chambers which store the liquid to be ejected through the ejection apertures; a plurality of supply ports through which the liquid is supplied to the pressure chambers; and a plurality of piezoelectric elements which apply pressure to the liquid in the pressure chambers to eject the liquid through the ejection apertures, the piezoelectric elements being connected in a matrix connection, each of the piezoelectric elements having a first electrode and a second electrode;

a drive signal generating device which generates a drive signal with voltage of a single polarity to be applied to the piezoelectric elements;

a drive controlling device which controls a timing for applying the drive signal to each of the piezoelectric elements; and a plurality of switching devices which apply the drive signal to the piezoelectric elements according to control of the drive controlling device, a number of the plurality of switching devices being smaller than a number of the plurality of piezoelectric elements, wherein the drive controlling device operates one of the piezoelectric elements in a direction in which the liquid is pulled toward inside of the ejection aperture to the pressure chamber by setting the second electrode of the one of the piezoelectric elements to a reference potential while applying the drive signal with voltage of the single polarity to the first electrode of the one of the piezoelectric elements and then operates the one of the piezoelectric elements in a direction in which the liquid is pushed toward outside of the ejection aperture by setting the first electrode of the one of the piezoelectric elements to the reference potential while applying the drive signal with voltage of the single polarity to the second electrode of the one of the piezoelectric elements in succession.

14. The liquid ejection apparatus as defined in claim 13, wherein each of the piezoelectric elements has a structure in which piezoelectric body layer is interposed between the first electrode and the second electrode.

15. The liquid ejection apparatus as defined in claim 13, wherein a time interval between the drive signal applied to the first electrode and the drive signal applied to the second electrode is not longer than half of a cycle of the drive signal.

16. An image forming apparatus which comprises the liquid ejection apparatus as defined in claim 13 and forms a desired image on an ejection receiving medium by means of the liquid ejected from the liquid ejection apparatus.

17. The liquid ejection apparatus as defined in claim 13, wherein the voltage of the drive signal is as much as the liquid is not ejected with the drive signal alone.

18. The liquid ejection apparatus as defined in claim 13, wherein the drive signal has a waveform including an upwardly sloping part and a downwardly sloping part.

19. The liquid ejection apparatus as defined in claim 13, wherein:

the drive signal includes a row line drive signal having a plurality of waveform elements and a column line drive signal having another plurality of waveform elements;

the driving signal generating device includes a row line signal generating device generating the row line drive signal and a column line drive signal generating device generating the column line drive signal; and the switching devices select one of the waveform elements of the row line drive signal to be applied to the first electrodes through a row signal line, and select one of the waveform elements of the column line drive signal to be applied to the second electrodes through a column signal line.

20. The liquid ejection apparatus as defined in claim 13, wherein:

the drive signal has a plurality of waveform elements; and the switching devices select one of the waveform elements to be applied to the first electrodes through a row signal line, and select another one of the waveform elements to be applied to the second electrodes through a column signal line.

* * * * *